US005261703A

United States Patent [19]

Lenkoff

[11] Patent Number: 5,261,703

[45] Date of Patent: Nov. 16, 1993

[54] GREETING CARD WITH COMPATIBLE PUZZLE MESSAGE

[75] Inventor: Roger J. Lenkoff, Louisville, Ky.

[73] Assignee: Stry-Lenkoff Company, Louisville, Ky.

[21] Appl. No.: 997,330

[22] Filed: Dec. 28, 1992

[51] Int. Cl.[5] ..... B42D 15/00

[52] U.S. Cl. ..... 283/117; 40/124.1

[58] Field of Search ..... 283/117; 446/147, 149; 40/124.1

[56] References Cited

U.S. PATENT DOCUMENTS 3,235,988 2/1966 Paige ..... 40/124.1

4,404,764 9/1983 Wills et al. ..... 283/117 X 4,484,768 11/1984 Norfleet ..... 283/1

4,586,714 5/1986 Lenkoff ..... 273/157

5,102,171 4/1992 Saetre ..... 283/117 X

*Primary Examiner*—Mark Rosenbaum

*Assistant Examiner*—Willmon Fridie, Jr.

*Attorney, Agent, or Firm*—Polster, Lieder, Woodruff & Lucchesi

[57] ABSTRACT

A greeting card with a compatible puzzle message including a visible opening first message, a visible outline to be completed as a second visible message compatible with the first message and means associated with the card to be used by the card recipient to complete the second compatible message within the visible outline.

11 Claims, 3 Drawing Sheets

GREETING CARD WITH COMPATIBLE PUZZLE MESSAGE

BACKGROUND OF THE INVENTION

The present invention relates to a novel greeting card arrangement including a puzzle game wherein segments of an image of a message compatible with an opening first visible image are included with a greeting card to be assembled by a card recipient in order to receive such compatible image.

Segmented jigsaw puzzles are long known in the art with jumbled or scrambled unrelated segments being of the same or of various sizes to be pieced, interlocked or dovetailed together in correctly recomposed form to produce a visible message which can be expressed in language form, picture form or both. Such an arrangement can be found in U.S. Pat. No. 4,586,714, issued to Leon G. Lenkoff et al on May 6, 1986. This patent further includes a unique arrangement for extending the visual art of each of the picture segments comprising part of an overall puzzle in conceptual form beyond a segment's peripheral edge into a portion of space between segments a sufficient distance to accommodate for manufacturing severing tolerances so that recomposition of the segments provides a clear, correctly recomposed picture.

In addition, greeting cards which include something more than a message have been known in the art, attention being directed to the "pop-up" art card taught by U.S. Pat. No. 3,235,988, issued to Richard E. Paige on Feb. 22, 1966 and to the fragrant odor release greeting card of U.S. Pat. No. 4,484,768, issued to Lincoln H. Norfleet on Nov. 27, 1984.

The present invention recognizing the desirability of providing a greeting card with something more than just a greeting message so as to enhance and extend the recipient's pleasant remembrance of the sender provides a unique greeting card which can be readily manufactured assembled, and mailed without extensive postage fees to present to a card recipient not only a colorful opening message but a compatible message in puzzle game form with the message being part of a pleasant game. Such an arrangement serves to add to both the enjoyment of the card recipient and to more positively fix the remembrance in the form of a compatible message with the visible opening message or messages located elsewhere on the greeting card.

Various other features of the present invention will become obvious to one skilled in the greeting card art upon reading the disclosure set forth herein.

BRIEF SUMMARY OF THE INVENTION

More particularly, the present invention relates to a greeting card including a first area having a visible opening first message from a sender; a second area having a visible outline arranged to be completed by the card recipient as a second visible message compatible with the first message; and, means associated with the card in a third area to be used by the card recipient to complete the second compatible visible image within the visible outline in the second area.

It is to be understood that various changes can be made by one skilled in the art in one or more of the several parts of the structural arrangement disclosed without departing from the scope or spirit of the invention. For example, instead of a folded card, it would be possible to use a one sheet card including three selected areas. Further, other types of puzzles could be used to complete an image in the outlined area.

BRIEF DESCRIPTION OF THE INVENTION

Referring to the drawings which disclose one advantageous embodiment of the present invention:

FIG. 1 is an isometric view of a partially open greeting card in the form of a booklet incorporating the features of the invention, disclosing the front face of the front plate and a portion of the inside face of the back plate of the booklet;

FIG. 2 is a plan view of the booklet of FIG. 1 in open form disclosing the two inside faces thereof with the right-hand face disclosing an indicia marked grid and the left-hand face disclosing a jumbled or scrambled unrelated puzzle with indicia marks thereon for proper assembly as a related image in the grid on the right-hand face; and, FIG. 3 is a similar plan view as disclosed in FIG. 2 with the jumbled puzzle of the left-hand inside face of the booklet in assembled form in the grid on the right-hand inside face.

DETAILED DESCRIPTION OF THE DRAWINGS

Figure 1:
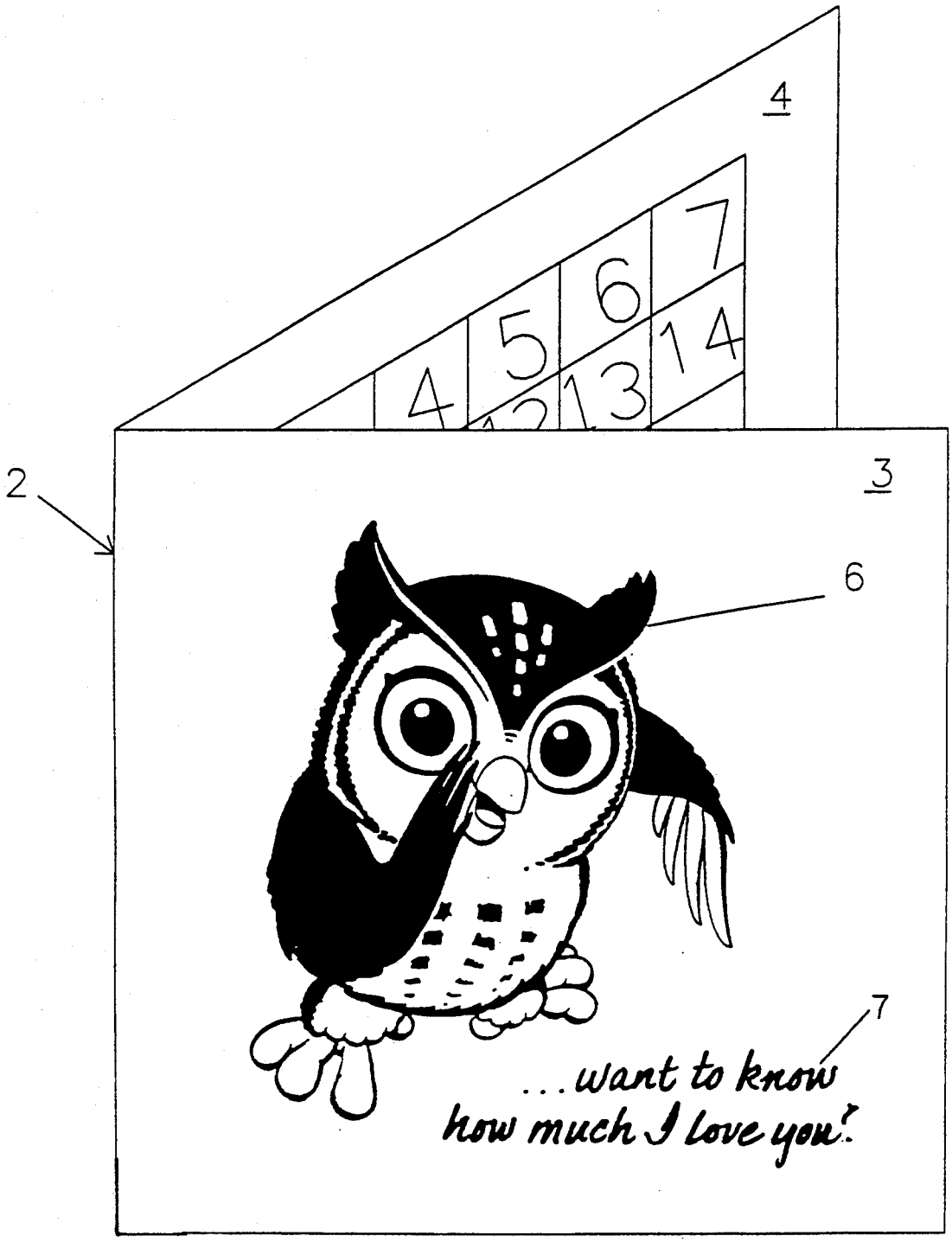

Referring to FIG. 1 of the drawings, a rectangular shaped greeting card 2 incorporating the unique features of the present invention is disclosed in the form of a folded booklet 2 having front and back plates 3 and 4 so as to include front and back faces and two inside faces to provide appropriately selected areas to accommodate the several features of the invention. It is to be understood that the present invention is not limited to the rectangular booklet shape shown in the drawings but that other geometrically shaped greeting cards can be utilized including a single plate card including only a front and back face to provide appropriate areas for the invention.

As can be seen in FIG. 1, the front face of front plate 3 of card 2 is provided with a first area including a visible opening first message to a card recipient printed thereon. Here it is shown as a picture 6 and a written accompanying question 7, the picture being in the form of a questioning owl with an accompanying written question message "... want to know how much I love you?..."

Figure 2:
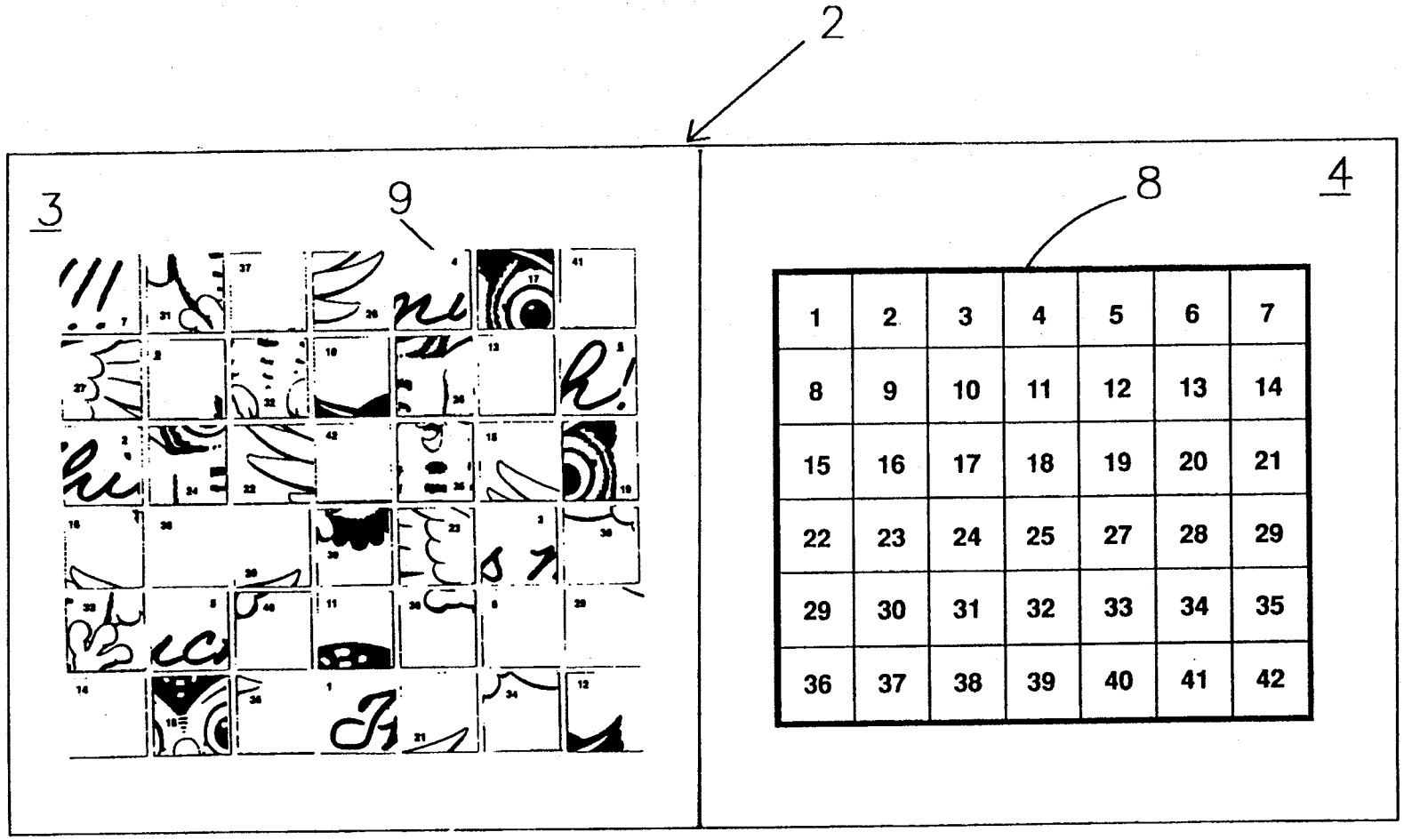

By turning the front plate to reveal the two adjacent inside faces of front and back plates 3 and 4 respectively (FIG. 2), a second area can be seen on the right-hand inside face of back plate having a visible outline printed thereon in the form of a rectangular grid 8 which is here shown as subdivided into forty-two (42) square segments, each with a distinct visible indicia numeral thereon. The numerals in the embodiment disclosed are consecutively and clearly marked in Arabic numerals from one through forty-two (1–42) in six horizontally extending rows of seven squares or segments in grid 8. It is to be understood that the grid 8 can be of other geometric shapes as can the indicia. For example, if the theme of the greeting card involved a birthday, an appropriate variety of colored or numbered candles could be used. Or, if the theme involved a Christmas theme, an appropriate variety of colored or numbered candy sticks or other holiday symbols could be used.

The indicia marked squares shown serve to receive a corresponding indicia marked square segment from a third area of the greeting card 2, each segment serving as a portion of a picture to be completed within the visible outline as a second visible message compatible with the aforedescribed visible opening first message in the form of the questioning owl printed on the front face of front plate 3 of card 2.

Figure 3:
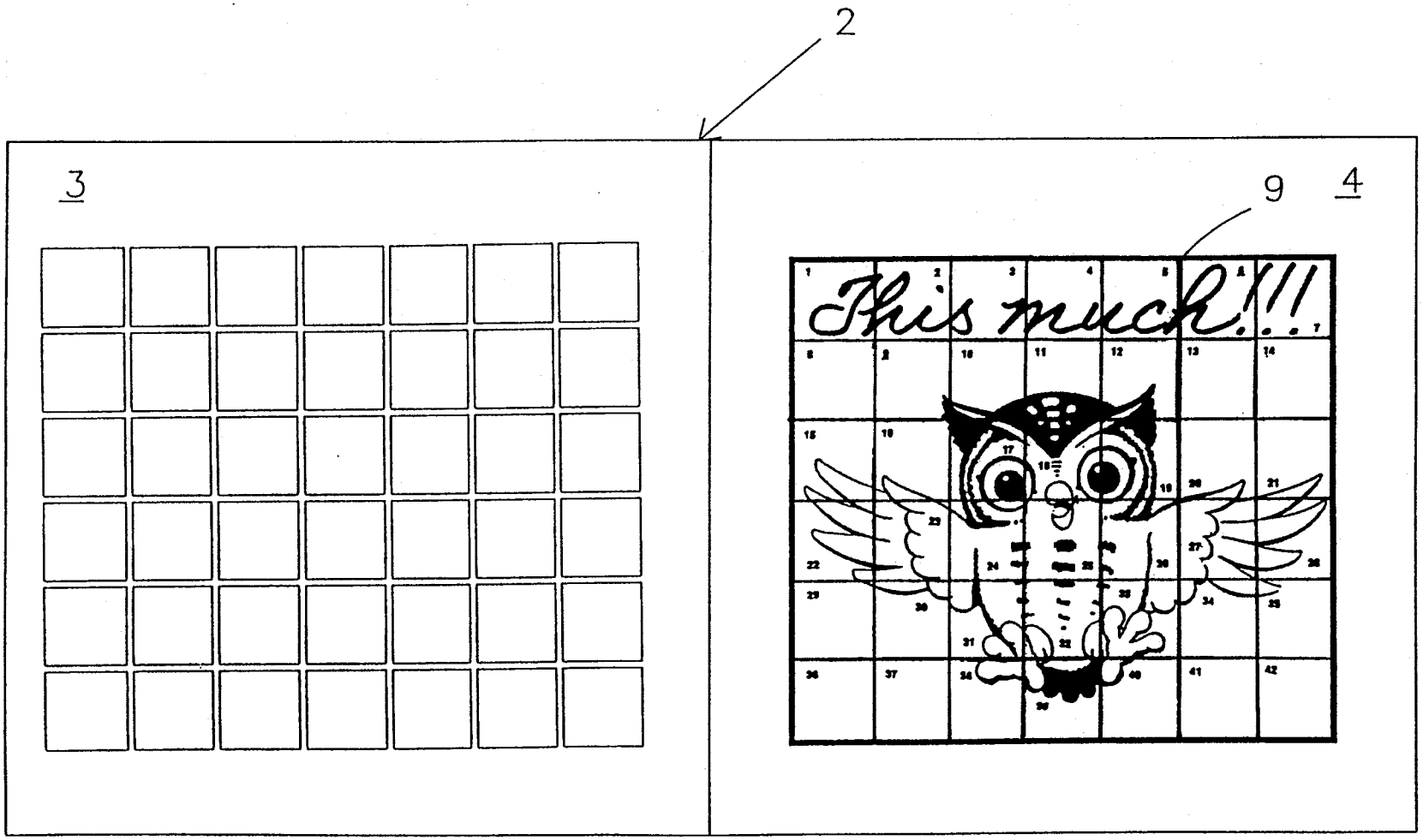

A third area is printed on the left-hand inside face of front plate 3. This third area serves to accommodate a rectangular jumbled or scrambled picture package 9 segmented and sized to correspond with the visible grid 8. In the embodiment disclosed, jumbled or scrambled unrelated picture 9 is divided into forty-two square segments, each corresponding with a square segment of visible grid 8 in the second area on the right-hand inside face of back plate 4 of booklet 2. As shown, each segment has a distinct visible numeral to correspond with one of the forty-two distinct numeral indicia printed on each segment of subdivided grid 8 in the second area. It is to be understood that advantageously the visual art of each picture segment can extend in conceptual form beyond its peripheral edge into a portion of a space between jumbled segments a sufficient distance to accommodate for manufacturing severing tolerances as disclosed in U.S. Pat. No. 4,586,714 above mentioned. Further, each segment can be of a different geometric shape, as can the accomodating grid 8 receiving the same and each segment can be provided with a suitable adhesive on the back portion thereof so as to insure clear, substantially uninterrupted and correct assemblage in the squares of the visibly marked grid 8 in the second area on the opposite inside face of the booklet 2. Although in the embodiment of the invention disclosed, the jumbled or scrambled unrelated picture 9 is shown as adhesively mounted in jumbled or scrambled related fashion on the left-hand inside face of booklet 2, in an alternative embodiment, the jumbled or scrambled unrelated picture 9 can be disposed in a suitable package, preferably transparent, hinged in the third area to leave a fourth area to accommodate a written note from a sender to the card recipient or a further message. In accordance with still another feature of the present invention, a fully visible completed second compatible image picture can be provided for the sender such as that shown in the assembled card 2 of FIG. 3 wherein the jumbled or scrambled unrelated segments 9 on the left inside face have been transferred to grid 8 on the right inside face of card 2. This picture can be included in the hinged package along with picture puzzle 9 and can be appropriately marked for senders use in order to inform sender as to the appearance of the second image when assembled by a card recipient.

Thus, in accordance with the present invention, a novel greeting card is provided which can be readily and economically manufactured to incorporate a variety of greeting themes, affording to a card recipient both the pleasure of a rememberable greeting and the added entertainment of puzzle assembly.

The invention claimed is:

1. A greeting card including a first area having a visible introductory first message from a sender to a card recipient; a second area having a visible outline, said outline defining boundaries for an uncompleted message to be completed by said card recipient as a second visible message compatible with said first message; and, means to complete said uncompleted message associated with said card in a third area to be used by said recipient to complete said second uncompleted message within said visible outline in said second area.

2. The greeting card of claim 1, said greeting card being in the form of a folded booklet to include a front and back plate with two inside faces with said first area having said visible introductory first message being on the front face of said front plate; said second area having said visible outline defining boundaries for an uncompleted message being on one of said inside faces of said booklet; and said third area having the means to complete said uncompleted message associated therewith being on the other of said inside faces of said booklet.

3. The greeting card of claim 2, said plate having said second area with said visible outline being said right-hand inside plate on the opposite face of said back plate and said third area being on the left inside plate on the opposite face of said front plate.

4. The greeting card of claim 1, said card including a fourth area to accommodate a written note from a sender to said card recipient.

5. The greeting card of claim 1, and a visible fully completed second compatible image accompanying said greeting card for the benefit of a sender to inform the sender of the greeting card of the full text of the second visible image to be completed by said card recipient.

6. The greeting card of claim 1, said means associated with said card in said third area including separate geometric segments of a total picture image in scrambled unrelated fashion to be positioned on said visible outline in said second area to form a related correct picture image within the visible grid.

7. The greeting card of claim 6, said scrambled unrelated geometric segments each having a distinct visible indicia thereon corresponding with a distinct visible indicia within said outline in said second area to facilitate formation and completion of said second compatible visible image within said visible outline in said second area.

8. The greeting card of claim 7, said visible outline in said second area being in the form of a visible grid with distinct visible indicia numerals thereon in each grid segment corresponding with distinct visible indicia numerals on each jumbled geometric segment, said scrambled unrelated geometric segments each having adhesive on the back portion thereof for fastening in an appropriate grid segment.

9. The greeting card of claim 8, said scrambled unrelated segments being assembled as a scrambled unrelated picture in said third area with the visual art of each of said picture segments extending in conceptual form beyond its peripheral edge into a portion of a space between scrambled unrelated segments a distance to accommodate for manufacturing severing tolerance to insure clear, substantially uninterrupted assemblage in said visibly marked grid in said second area.

10. The greeting card of claim 1, said third area including a package hingedly fastened thereto to include said completion means for ready access by said card recipient.

11. A greeting card comprising: a folded booklet having front and back plates to include front and back faces and two inside faces to provide at least four plate areas including a first area on said front face of said front plate having a visible introductory first message to a card recipient printed thereon; a second area on said right-hand inside face of said back plate having a visible outline printed thereon in the form of a rectangular grid subdivided into rectangular squares, each with an uncompleted message therein in the form of a distinct visible indicia numeral thereon to receive a corresponding indicia marked square segment from a third area of said greeting card as a portion of picture to be completed within said visible outline as a second visible message compatible with said visible introductory first message printed on said front face of said front plate of said card; a third area on said left-hand inside face of said front plate, said third area having a scrambled picture package hingedly fastened thereto to include a rectangular scrambled picture therein segmented and sized to correspond with said visible grid and subdivided into scrambled square segments, each corresponding with a square segment of said visible grid in said second area, each segment having a distinct visible numeral thereon to correspond with a distinct numeral printed on a segment of said subdivided grid in said second area with the visual art of each picture segment extending in conceptual form beyond its peripheral edge into a portion of a space between jumbled segments a distance to accommodate for manufacturing severing tolerance and having an adhesive on the back portion thereof to insure clear, substantially uninterrupted and correct assemblage in said visibly marked grid in said second area to complete said message in said second area with said hinged package leaving a fourth area on said left-hand inside face to accommodate a written note from a sender to said card recipient; and, a visible fully completed second compatible image included with said scrambled picture package for the benefit of a sender and so marked so that the sender can be informed of the second compatible visible image to be completed by said card recipient.

* * * * *

UNITED STATES PATENT AND TRADEMARK OFFICE

CERTIFICATE OF CORRECTION

PATENT NO. : 5,261,703

DATED : November 16, 1993

INVENTOR(S) : Roger J. Lenkoff

It is certified that error appears in the above-identified patent and that said Letters Patent is hereby corrected as shown below:

In column 3, line 33, after "scrambled", correct "related" to read --- unrelated ---.

Signed and Sealed this

Twenty-sixth Day of April, 1994

*Attest:*

*Attesting Officer*

BRUCE LEHMAN

*Commissioner of Patents and Trademarks*